United States Patent [19]

McDowell

[11] 4,107,789

[45] Aug. 15, 1978

[54] METHOD AND APPARATUS FOR UNIFORMLY PNEUMATICALLY DISPERSING MATERIAL

[75] Inventor: Robert McDowell, Aiken County, S.C.

[73] Assignees: Bevil J. Kilgore, Sheffield, Ala.; James H. Backus, Alexandria, Va.

[21] Appl. No.: 653,024

[22] Filed: Jan. 28, 1976

[51] Int. Cl.[2] ..... B01F 15/02; B01F 9/12; B28C 5/06

[52] U.S. Cl. ..... 366/3; 366/30; 366/56; 366/65

[58] Field of Search ..... 259/3, 9, 10, 15, 21, 259/25, 26, 147, 151, 154, 164, 165, 174, DIG. 17, 146, 145; 222/195, 196; 141/67, 367, 368; 302/59; 193/4

[56] References Cited

U.S. PATENT DOCUMENTS

| | | | |
|---|---|---|---|
| 3,102,603 | 9/1963 | Kerr | 222/195 X |
| 3,128,997 | 4/1964 | Young | 259/154 X |
| 3,230,589 | 1/1966 | McIlvane | 259/154 X |
| 3,253,750 | 5/1966 | Paton | 222/195 |
| 3,256,181 | 6/1966 | Zingg et al. | 259/154 X |
| 3,542,251 | 11/1970 | Pfeuffer | 222/195 |

*Primary Examiner*—Robert W. Jenkins

*Attorney, Agent, or Firm*—Lowe, King, Price & Markva

[57] ABSTRACT

The invention employs high volume air to form a cloud of coating material or material to be uniformly dispersed and conveys it to a plenum or common area of the receiving material which is coated. A mixer creates turbulence in the receiving material to turn up new receiving material to be coated. The invention has application to cement mixing, pigment and starch mixing, or even the mixing of atomized or vaporized fluid with on or more receiving materials to establish optimum surface connection for producing stronger cement or utilizing less materials for the same strength or optimizing the dispersion of the cloud introduced material with the receiving material.

11 Claims, 8 Drawing Figures

METHOD AND APPARATUS FOR UNIFORMLY PNEUMATICALLY DISPERSING MATERIAL

Figure 1:
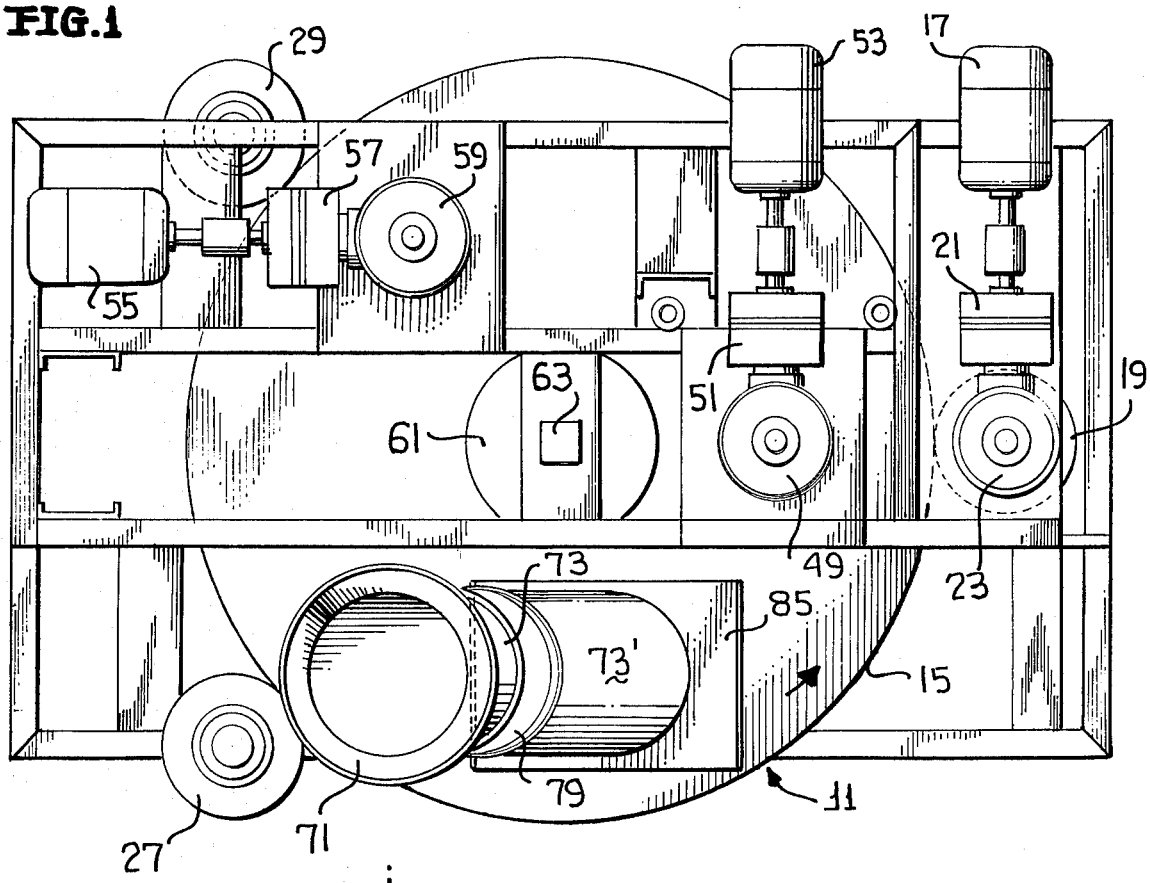

The present invention comprises apparatus and a method for uniformly introducing any powder, granulated, or flaked substance such as cement, starch, pigment, or the like into a mixing batch during the stirring process. High volume preferably low pressure air is employed to produce a cloud of the material to be dispersed or employed as a coating and the air separates the individual particles of the coating material and spreads it uniformly across the surface of a predetermined area of the receiving material which is agitated to present new surfaces of receiving material to the cloud of material to be dispersed.

The invention has been applied to cement mixing, starch dispersion, and pigment dispersion into starch for the textile industry. Its usefulness, however, is not limited to these fields but to the mixing of any materials wherein coating or uniform dispersion is optimized to improve the characteristics of the final mixture.

This invention, in one application, introduces the cement powder into a cement mixer, which may contain the aggregate, primarily by means of air pressure, which separates the individual particles and introduces the cement powder across the surface of the aggregate in the mixer. The introducing chute may receive the cement powder from a weigh-batcher in the presence of the air pressure and deliver it to a conventional mixer by way of an air-tight chute which opens in the form of a plenum or dust box to a portion of the surface area of the aggregate in the conventional mixer. The purpose of the mixer is simply to present continuing new surface areas of the aggregate to the cloud of cement dust for coating.

A controlled pressure air nozzle forces the gravity fed cement powder through an adjustable orifice gate which is provided to regulate the volume of flow to optimize the application of the cement powder to the aggregate. The plenum area or dust box may be vaned if desired, but is preferably open and is positioned inside the mixer above the surface of the batch. A flexible skirt, i.e., rubber or the like, connects the dust box to the surface of the batch to maintain the dust cloud intact. Turbulence created by the cement being forced through the distribution head causes an atomizing effect such that the exposed surface of the batch, within the skirt, is constantly saturated with cement. In this manner, the desirable result is obtained in that all lumps, clots, cakes, and irregular cohesions usually associated with conventional methods of mixing are virtually eliminated thereby producing a product with controlled quality and regularity. Additionally, the method is more efficient than conventional methods in several ways.

First, man-hour savings are realized in that a single operator may attend two or more mixing operations simultaneously. Also, the time required for each mixing cycle is appreciably reduced and, of course, less cement is required for attaining the same strength concrete because of the more efficient mixing. Alternatively, a standard amount of cement will produce a higher strength concrete than heretofore attained also as a result of the more efficient mixing.

The cement may be weigh-batched and timed, if desired, to regulate the mixing time cycle. The process can be accomplished quickly when a large volume of air is employed, or it may be extended for even more thorough mixing because it is desirable that all of the material in the mixer be presented to the cloud of dispersing material for uniform coating or dispersion. Thus, the adjustment of the air pressure (usually in the range of 8 to 10 psi at the batching surface), setting of the orifice gate open, size and speed of the mixer are all variable parameters which can be adjusted by the operator to achieve optimum efficiency of dispersion or coating. But, in any event, the principle of this method and apparatus provides a more efficient mixing action than conventional processes even when not adjusted to optimum settings.

By way of example, in producing 3,000 psi concrete, the present method may utilize 5 cubic feet of cement rather than 5½ cubic feet of cement because of the improved surface area coating. While it has been mentioned that a lot of air combined with a lot of cement can quickly be mixed with the aggregate, it should also be mentioned that a little air combined with a little cement can slowly be mixed with the aggregate to achieve the same ultimate mix, the object being simply to coat all of the aggregate.

While the foregoing description is related to the more efficient production of concrete, it should be realized that a great many mixes, dispersions, or coatings may be achieved utilizing almost any materials. Granular starch has been mixed with water, dry pigment has been mixed with dry starch for textile dye, and cement has been mixed in varying formulas. It is only logical to assume that the invention can be extended to efficient mixing in many, many other fields.

Figure 2:
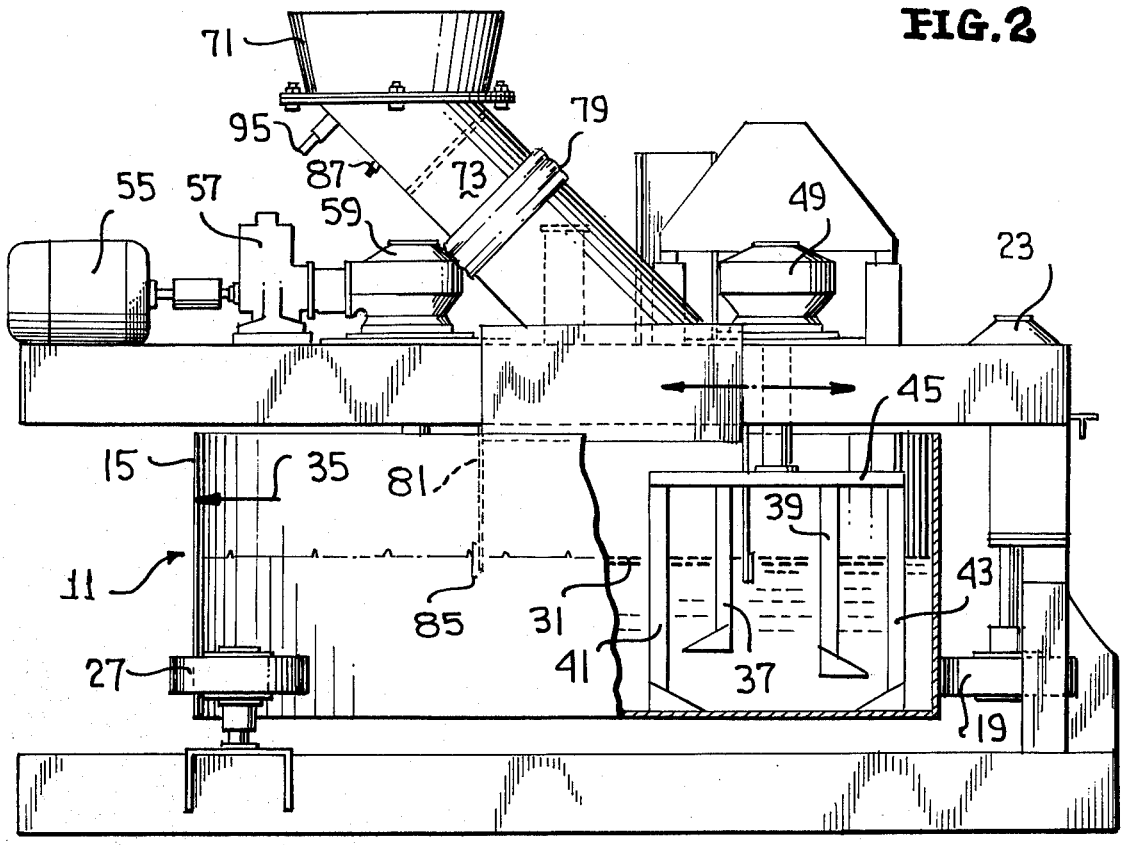
Figure 3:
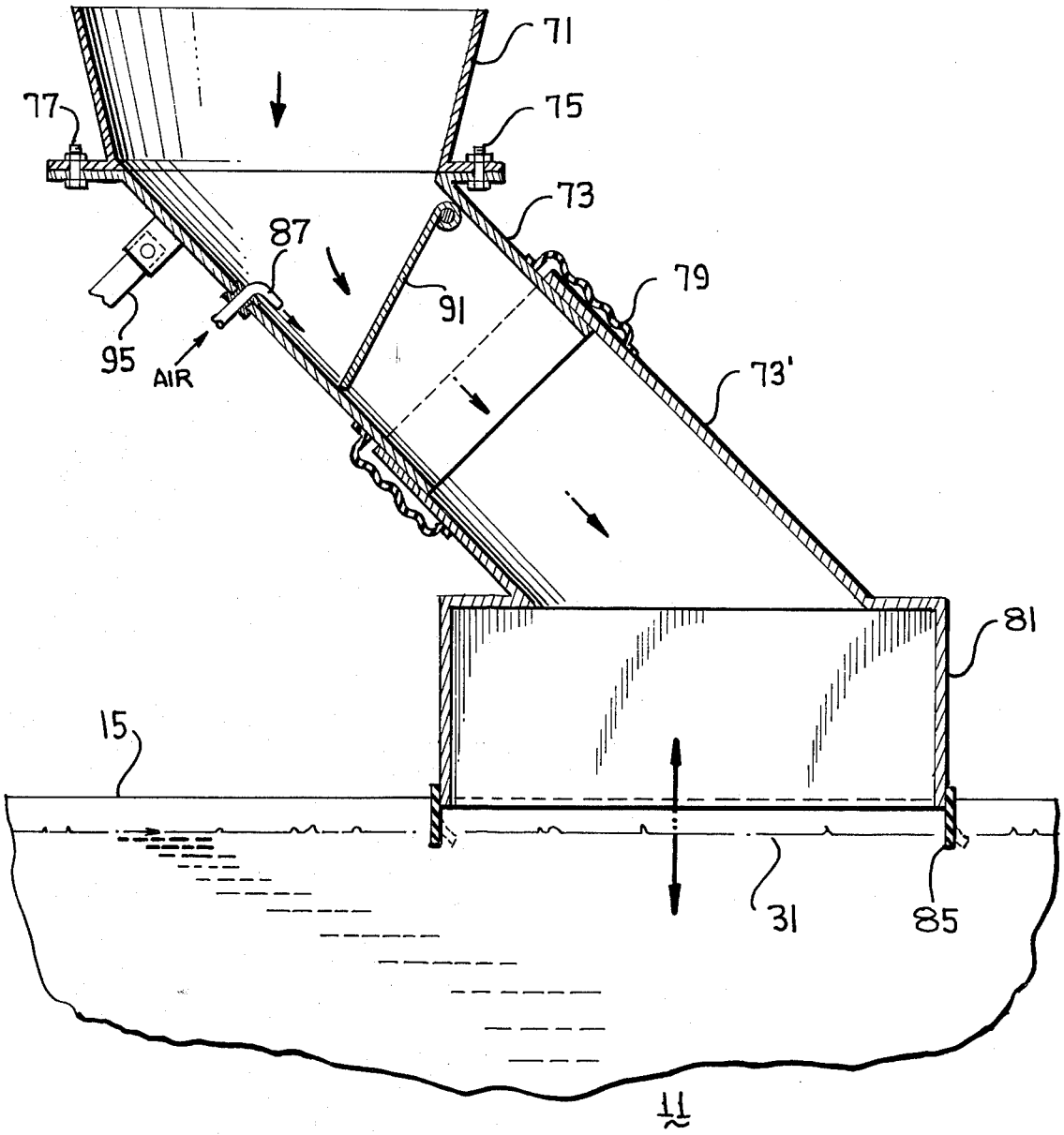
Figure 4:
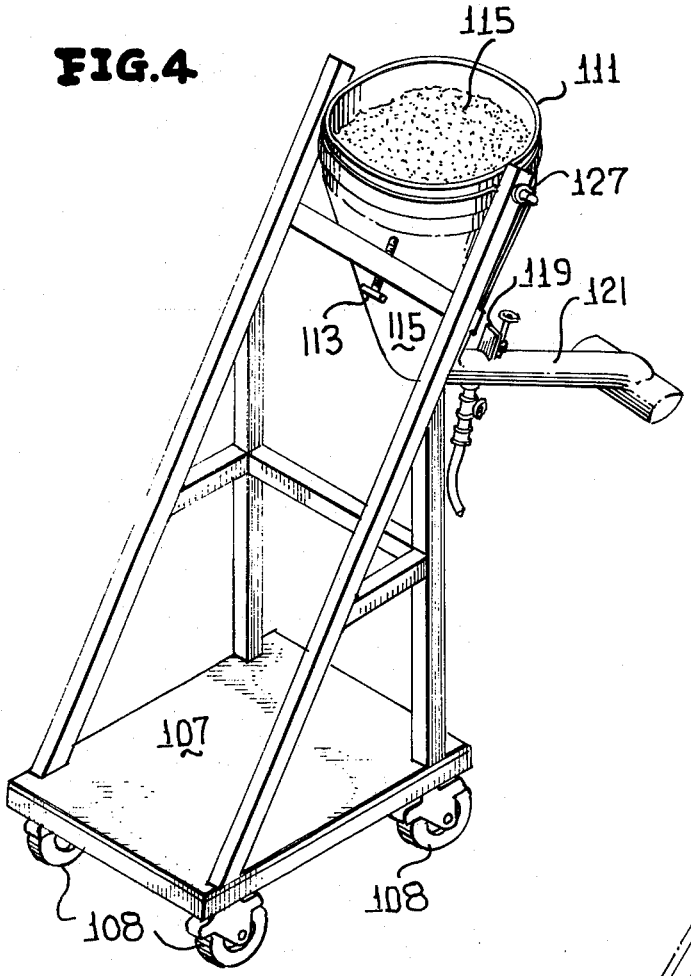
Figure 5:
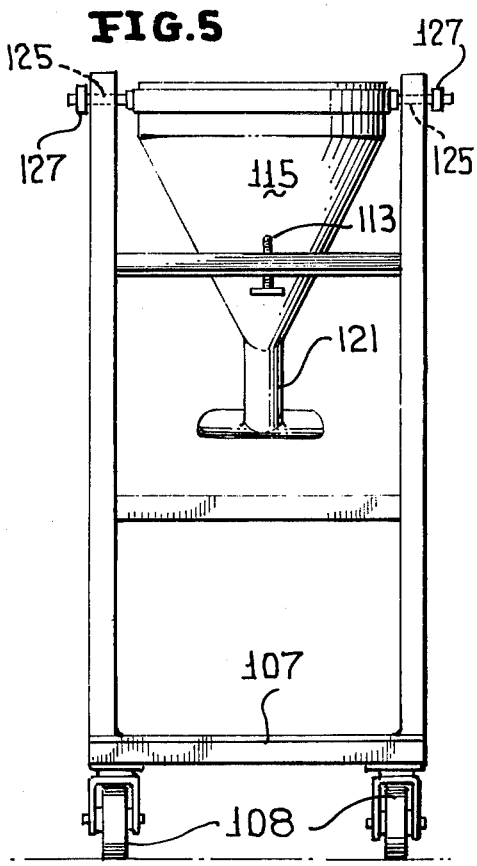
Figure 6:
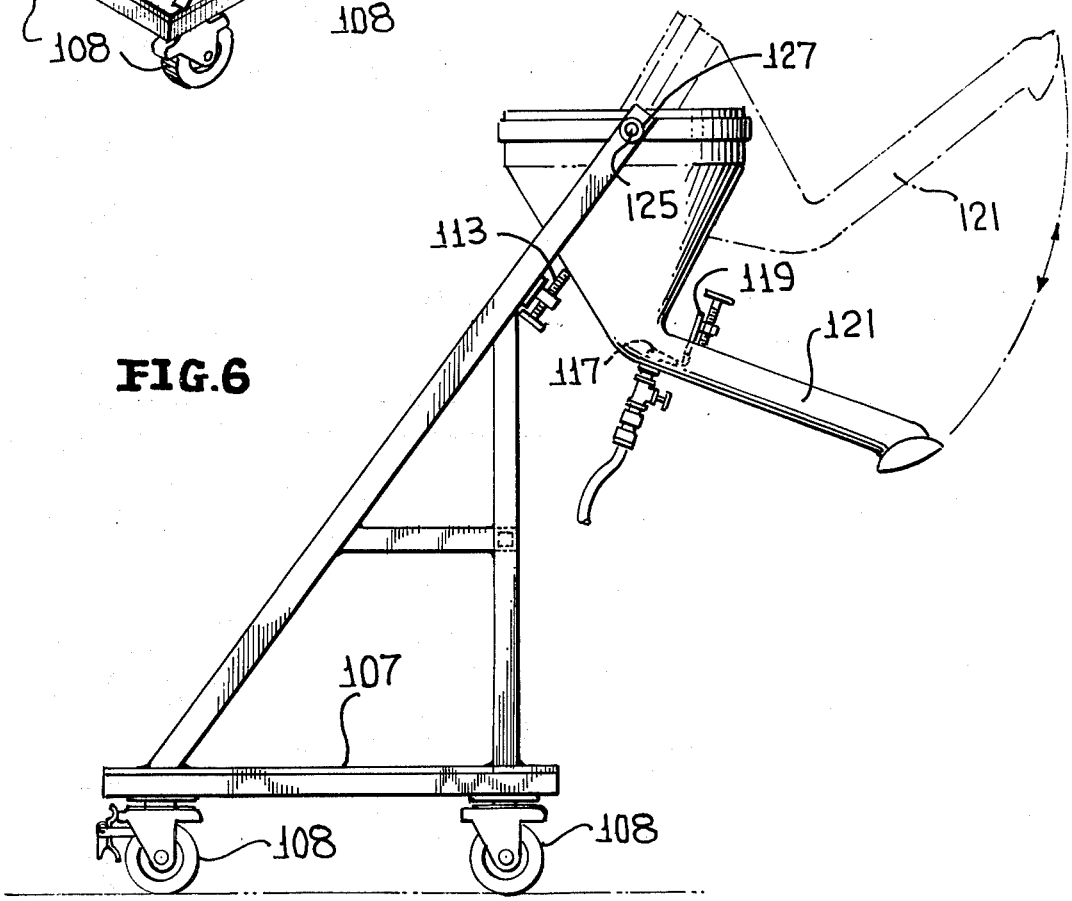
Figure 7:
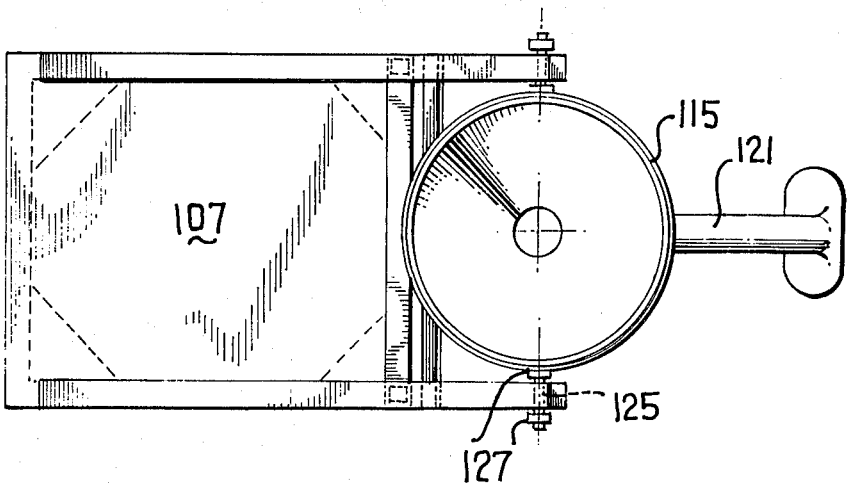
Figure 8:
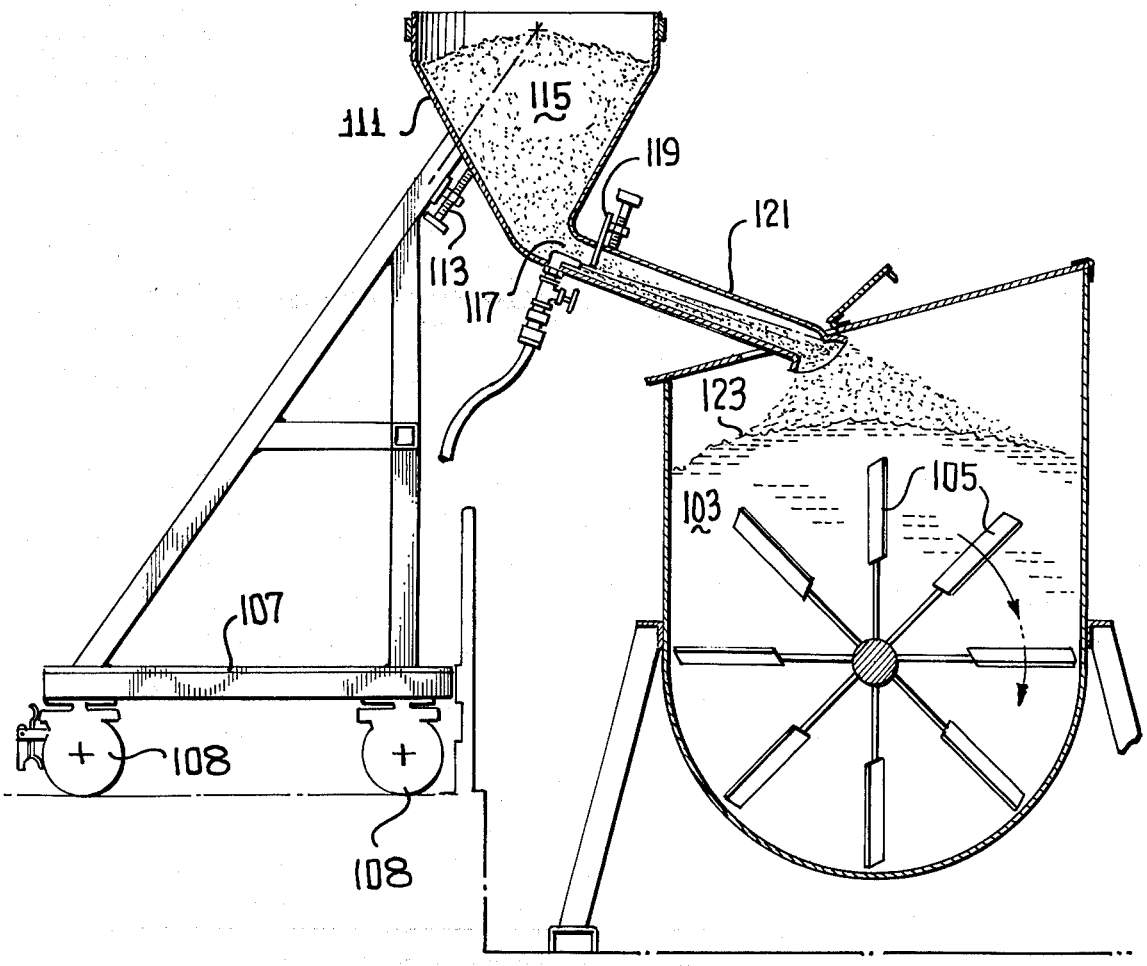

The invention will be better understood from a reading of the following description thereof when taken in the light of the accompanying drawings wherein:

FIG. 1 is a view in plan of the invention incorporating a mixer of conventional manufacture, FIG. 2 is a view partly in side elevation and partly broken away better to reveal the apparatus of FIG. 1, FIG. 3 shows suitable apparatus in section for producing a cloud of dispersing material and introducing the same to an agitated surface, FIG. 4 shows a slightly different type of dispersing apparatus in perspective, FIG. 5 is a view of the structure of FIG. 4 from the rear, FIG. 6 is a view of the structure of FIGS. 4 and 5 in side elevation, FIG. 7 is a view of the structure of FIG. 6 in plan, and FIG. 8 shows the apparatus of FIG. 7 in association with a textile mixer for producing dye receiving gum.

Considering now FIGS. 1 and 2, a conventional mixer 11 is shown incorporating the present invention. This mixer is available under the trade name "Roto-Mixer" from Concrete Equipment Co., Incl., of Sheffield, Alabama. Basically, it comprises a mixer shell 15 suitably bearinged for rotation as a result of mixer rotor 17 driving a rubber tired drive wheel 19 through gear reduction box 21 and right-angle drive 23. A pair of idler rubber tires 27 and 29 stabilizes the rotation of shell 15. The batch level is shown at 31 for the particular mix in mixer 11 which may be a wet or high slump mix level for ready-mix concrete or the like. The level 31 is approximately 20 inches below the top of shell 15 for such mixes. However, when running a dry or low slump mix level, it may attain the height of arrow 35, as when mixing concrete for blocks and the like. This level may be, for example, 4 inches from the top of shell 15.

A plurality of uplift mixer blades are employed in mixer shell 15 at different heights to achieve the necessary turbulence. In FIG. 2 a pair of uplift mixer blades 37 and 39 are shown in the break away portion of this figure. These blades are located between outer uplift mixer blades 41 and 43, all depending from circular plate 45 affixed to driving shaft 47 in turn connected to right-angle drive 49 and via gear reduction box 51 to mixer blade drive motor 53.

A second set of uplift mixer blades is driven by motor 55 through box 57 and right-angle drive 59.

The mixer 11 is adapted to impart its contents quickly through discharge door 61 operated by means of air cylinder 63 lifting the door 61 to drop the batch into a chute or concrete truck or the like (not shown).

The present invention proposes the attachment of FIG. 3 to a mixer such as the one shown at 11.

A dispersion material hopper 71 is connected to a telescoping chute 73 by means of the flange bolts 75 and 77. The chute 73 may be lengthened or shortened by moving lower portion 73' upwardly or downwardly within rubber boot 79. This in turn raises and lowers the dust box 81 defining the plenum or common region between the surface 31 of the batch or receiving material and the region of dispersion cloud contained within box 81 and chute 73. A rubber or other flexible skirt 85 maintains the air-tight seal between dust box 81 and surface 31 in order that the air pressure may be maintained at surface 31 in the order of, for example, 8 to 10 psi.

This air pressure is produced as a result of high volume air being introduced into nozzle 87 to disperse the dispersing material being gravity fed through hopper 71. Nozzle 82 may, in fact, comprise simply ⅜ inch pipe, and, if desired, further nozzles may be employed, particularly in large batching operations. Its purpose is to entrain the powder and separate it into individual particles in the dust cloud effective at surface 31. The pressure at nozzle 87 may be, for example, 30 psi to produce an acceptable low pressure, high volume air at the common region.

An orifice cutoff gate 91 is provided to regulate the volume of dispersing material being entrained into the cloud. This gate may be remotely operated by an air cylinder or hydraulic system or even manually set. In some cases, it may be fully open and others, only slightly open, depending upon the setting determined for the most efficient mixing or dispersing action relative to the speed of presenting new receiving material to box 81.

A vibrator 95 is shown adjacent chute 73 for use with some materials. It is conventional and simply vibrates the chute and has been found useful when cement is being mixed but has not been found necessary for starch and pigment mixing.

In FIG. 2 it may be seen that the skirt 85 is in contact with level 31 about mid-way down shell 15. However, if the level reached arrow 35, it is desirable to have the skirt contact the new level. Thus, the chute 73 is elevated to a new position. This may be accomplished pneumatically by moving the hopper 71, chute 73 and dust box 81 upwardly, or it may be accomplished by telescoping the chute 73 upwardly and manually locking the same.

The source of air may be obtained from the normal manufacturing plant supply or from a small compressor, and one advantage of this closed system is that it is practically dust free thereby not only conserving the dispersion powder but also improving the environment.

The embodiment illustrated in FIGS. 4 through 8 operates on the same principle and simply shows a mixer 101 of conventional design presently being imported into this country partially filled with water 103 in which paddle wheels 105 are rotated. A platform 107 set on casters 108 pivotally suspends hopper 111 against stop 113.

Hopper 111 may include granular starch 115, for example, which is entrained by air emitted from nozzle 117 and passing over orifice gate 119 down chute 121 to disperse in the top surface 123 of water 103 being agitated.

The hopper 111 is pivotally carried on dowels 125 suitably bearinged at 127 to permit it to be tilted backward against platform 107 for transportation about the factory or yard.

It may now be appreciated that an important principle, inherent in the present invention, is the fact that coating proceeds at a uniform pace, because as damp areas are coated, the moving air simply moves the dispersed material to adjacent damp areas to coat them, and in turn, the coated receiving material is replaced by uncoated material, and this surface area is coated in the same manner because entrained material in the air is continuously moving.

What is claimed is:

1. The method of uniformly dispersing dry additive material into aggregate receiving material comprising the steps of:

entraining the additive material in air;

conducting the entrained material to a predetermined size surface area of the receiving material while, confining the entrained material to a closed space between a source of said additive material and said receiving material to form a cloud of additive material particles impinging on said predetermined size surface of the aggregate receiving material; and agitating the receiving material at said surface area to present new surface areas of receiving material to said entrained material.

2. The method of claim 1 including the further step of:

gating the additive material being conducted to control the quantity introduced to the receiving material.

3. The method of claim 1 wherein said air is high volume, low pressure air in the approximate range of 8–10 p.s.i. at said surface.

4. The method of claim 1 wherein said additive material is atomized.

5. Apparatus for uniformly dispersing dry additive material into aggregate receiving material comprising, in combination:

mixer means for agitating the receiving material to change the surface areas thereof;

means for entraining the additive material in air; and, means for conducting the entrained material into contact with a changing predetermined size surface area of said agitated receiving material;

said means for conducting comprising means for confining the entrained material to a closed space between a source of said additive material and said receiving material to form a cloud of additive material impinging on said predetermined size surface of the changing aggregate receiving material.

6. The apparatus of claim 5 further comprising:

gating means for controlling the quantity of additive material entrained.

7. Apparatus for uniformly dispersing additive material into receiving material comprising, in combination:

mixer means for agitating the receiving material;

means for entraining the additive material in air; and, means for conducting the entrained material into contact with a changing predetermined size surface area of said agitated receiving material comprising a chute;

a dust box in communication with said chute; and, a flexible skirt extending from the dust box to the surface of said receiving material to direct the entrained material into surface contact with the receiving material.

8. The apparatus of claim 7 further comprising:

adjustable gating means in said chute for restricting the quantity of additive material passing to said receiving material.

9. The apparatus of claim 8 further comprising:

vibrating means for vibrating said chute to assist the transport of said additive material.

10. Apparatus for dispersing additive material into agitated receiving material comprising, in combination:

means for entraining the additive material in air; and means for conducting the entrained material into contact with a surface area of said receiving material;

said means for conducting comprising:

a chute;

a dust box connected to said chute; and, a flexible skirt extending from the dust box to the surface of said receiving material.

11. The apparatus of claim 10 further comprising:

gating means for controlling the flow of additive material.

* * * * *